US006138625A

United States Patent [19]

Garrison

[11] Patent Number: 6,138,625

[45] Date of Patent: Oct. 31, 2000

[54] COMPACT HEAD ASSEMBLY FOR INTERNAL COMBUSTION ENGINE

[76] Inventor: John Michael Garrison, 9530 N. Moore Rd., Littleton, Colo. 80125

[21] Appl. No.: 09/271,054

[22] Filed: Mar. 17, 1999

Related U.S. Application Data

[60] Provisional application No. 60/078,309, Mar. 17, 1998.

[51] Int. Cl.[7] ..... F01L 1/18

[52] U.S. Cl. ..... 123/90.39; 123/90.41

[58] Field of Search ..... 123/90.27, 90.39, 123/90.41, 90.61, 90.16

[56] References Cited

U.S. PATENT DOCUMENTS

| | | | |
|---|---|---|---|
| Re. 33,870 | 4/1992 | Fittro et al. | 123/90.41 |
| 2,051,313 | 8/1936 | Olenick | 123/90.39 |
| 2,401,480 | 6/1946 | Halliday | 123/90.39 |
| 3,556,061 | 1/1971 | Schmidt et al. | 123/90.27 |
| 3,942,490 | 3/1976 | Scott | 123/90.4 |
| 4,449,490 | 5/1984 | Hansen | 123/79 |
| 4,476,822 | 10/1984 | Bonvallet | 123/90.41 |
| 4,491,099 | 1/1985 | Bonvallet | 123/90.44 |
| 4,519,345 | 5/1985 | Walter | 123/90.16 |
| 4,655,177 | 4/1987 | Wells et al. | 123/90.36 |
| 4,703,729 | 11/1987 | Sakano et al. | 123/308 |
| 4,721,007 | 1/1988 | Entzminger | 74/522 |
| 4,782,798 | 11/1988 | Jones | 123/90.11 |
| 4,799,464 | 1/1989 | Patel et al. | 123/90.41 |
| 4,848,180 | 7/1989 | Mills | 74/519 |
| 4,878,463 | 11/1989 | Fredericksen et al. | 123/90.41 |
| 4,944,256 | 7/1990 | Matayoshi et al. | 123/90.24 |
| 4,998,513 | 3/1991 | Gagnon | 123/76 |
| 5,022,360 | 6/1991 | Cholewczynski | 123/90.27 |
| 5,189,997 | 3/1993 | Schneider | 123/90.16 |
| 5,207,191 | 5/1993 | Pryba et al. | 123/90.39 |
| 5,235,942 | 8/1993 | Olmr | 123/90.27 |
| 5,433,178 | 7/1995 | Urmaza | 123/90.41 |
| 5,437,209 | 8/1995 | Santoro | 74/559 |
| 5,553,583 | 9/1996 | Jones | 123/90.34 |
| 5,560,265 | 10/1996 | Miller | 74/559 |
| 5,570,665 | 11/1996 | Regueiro | 123/90.27 |
| 5,596,958 | 1/1997 | Miller | 123/90.23 |
| 5,617,818 | 4/1997 | Lüders | 123/90.27 |
| 5,645,025 | 7/1997 | Caya et al. | 123/90.42 |
| 5,884,593 | 3/1999 | Immel et al. | 123/90.23 |
| 5,970,932 | 10/1999 | Richardson et al. | 123/90.36 |

*Primary Examiner*—Weilun Lo
*Attorney, Agent, or Firm*—Sheridan Ross P.C.

[57] ABSTRACT

An internal combustion engine head assembly is disclosed wherein the rocker arms for the intake and exhaust valves each have a portion that pivots about a common axis, and wherein these portions are concentric to one another. Thus, a very compact combustion head assembly is provided. In particular, the present invention is useful in Harley-Davidson motorcycles.

14 Claims, 10 Drawing Sheets

20

24

COMPACT HEAD ASSEMBLY FOR INTERNAL COMBUSTION ENGINE

CROSS-REFERENCE TO RELATED APPLICATIONS

This application claims priority from U.S. Provisional Application Ser. No. 60/078,309, filed Mar. 17, 1998, entitled "COMPACT HEAD ASSEMBLY FOR INTERNAL COMBUSTION ENGINE."

FIELD OF THE INVENTION

The present invention relates to a head assembly for an internal combustion engine, and in particular, to a compact rocker arm assembly useful in confined areas such as in motorcycles.

BACKGROUND OF THE INVENTION

Many internal combustion engines that are currently in use are based on engineering compromises between performance of the engine and additional constraints such as surrounding non-engine components. Such additional constraints many times cause such compromises to affect the performance of the engine since it is perceived that there is not sufficient room for more optimal configurations. Thus, more compact design of various engine components or assemblies is beneficial, particularly if such designs allow greater optimization of engine performance within substantially the same space constraints that the engine would occupy otherwise.

In many internal combustion engines, their performance can be substantially enhanced by reconfiguring the engine head assembly so that, for example, intake and exhaust valve angles are reoriented and the combustion chamber is reconfigured to provide higher compression ratios and greater homogeneity or atomization within the fuel mixtures provided to such engines. Further, it can be desirable to reconfigure the intake and exhaust ports to the cylinders of such engines so that there is both a decrease in flow impeding bends within the ports, and optionally, appropriate contours to at least the input port so that this contour facilitates mixing the fuel and air together prior to entering a cylinder for combustion. Thus, it would be advantageous to have a novel internal combustion engine head that performed such enhancements to internal combustion engines currently in use. In particular, it would be advantageous to have such an internal combustion engine head assembly for Harley-Davidson Sportster and Big Twin motorcycles since these motorcycles are extremely popular and may be able to benefit greatly from a redesigned engine head assembly.

SUMMARY OF THE INVENTION

The present invention is a novel internal combustion engine head assembly, wherein the rocker arms for the intake and exhaust valves each have a portion that pivots about a common axis, and wherein these portions are concentric to one another. Accordingly, the present invention provides a very compact combustion head assembly. In particular, the present invention includes intake and exhaust rocker arms wherein each arm has an arm part and a pivot part such that the arm part transfers a force between components of the engine for actuating an intake and/or exhaust valve, and the pivot part has a longitudinal axis about which it pivots during the transfer of forces.

Other features and benefits of the present invention will become evident from the detailed description and accompanying drawings.

BRIEF DESCRIPTION OF THE DRAWINGS

In relation to the respective view of FIG. 1.

DETAILED DESCRIPTION OF A PREFERRED EMBODIMENT OF THE INVENTION

Figure 1:
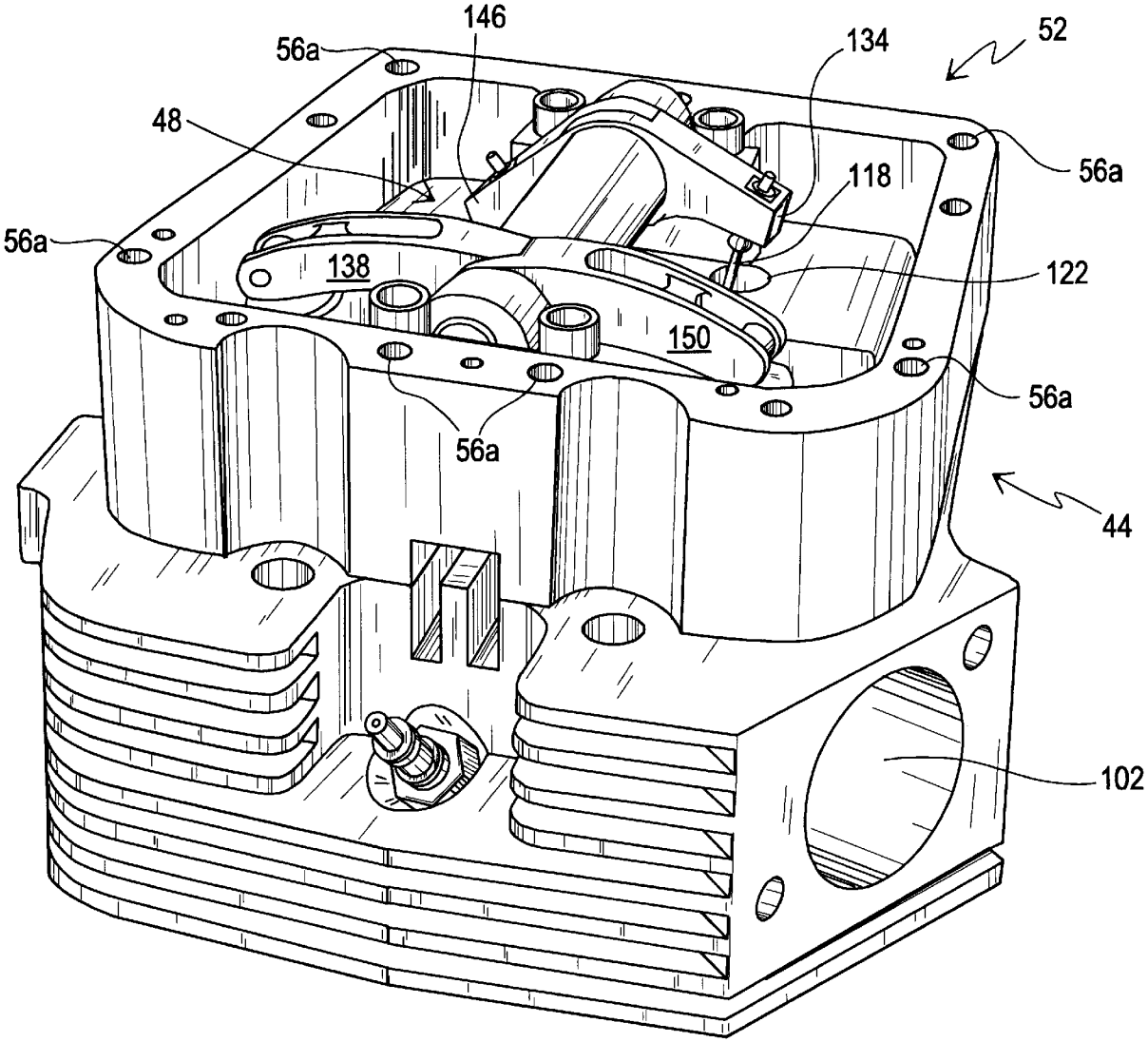
FIG. 1 is a perspective view of the present invention.
Figure 2:
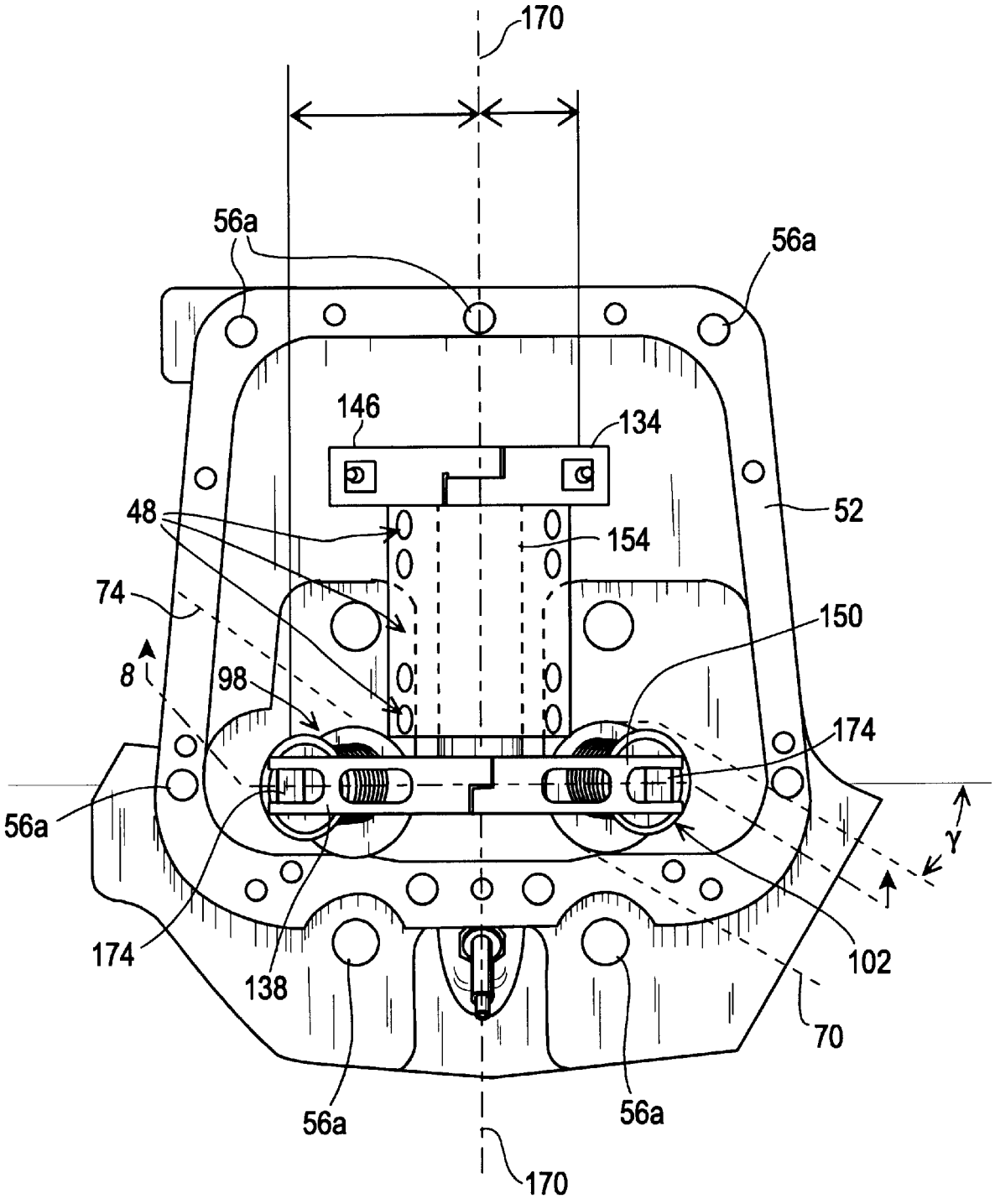
FIG. 2 is a plan view as the invention appears when looking down on the top surfaces, "top" being defined from the perspective orientation of FIG. 1.
Figure 7:
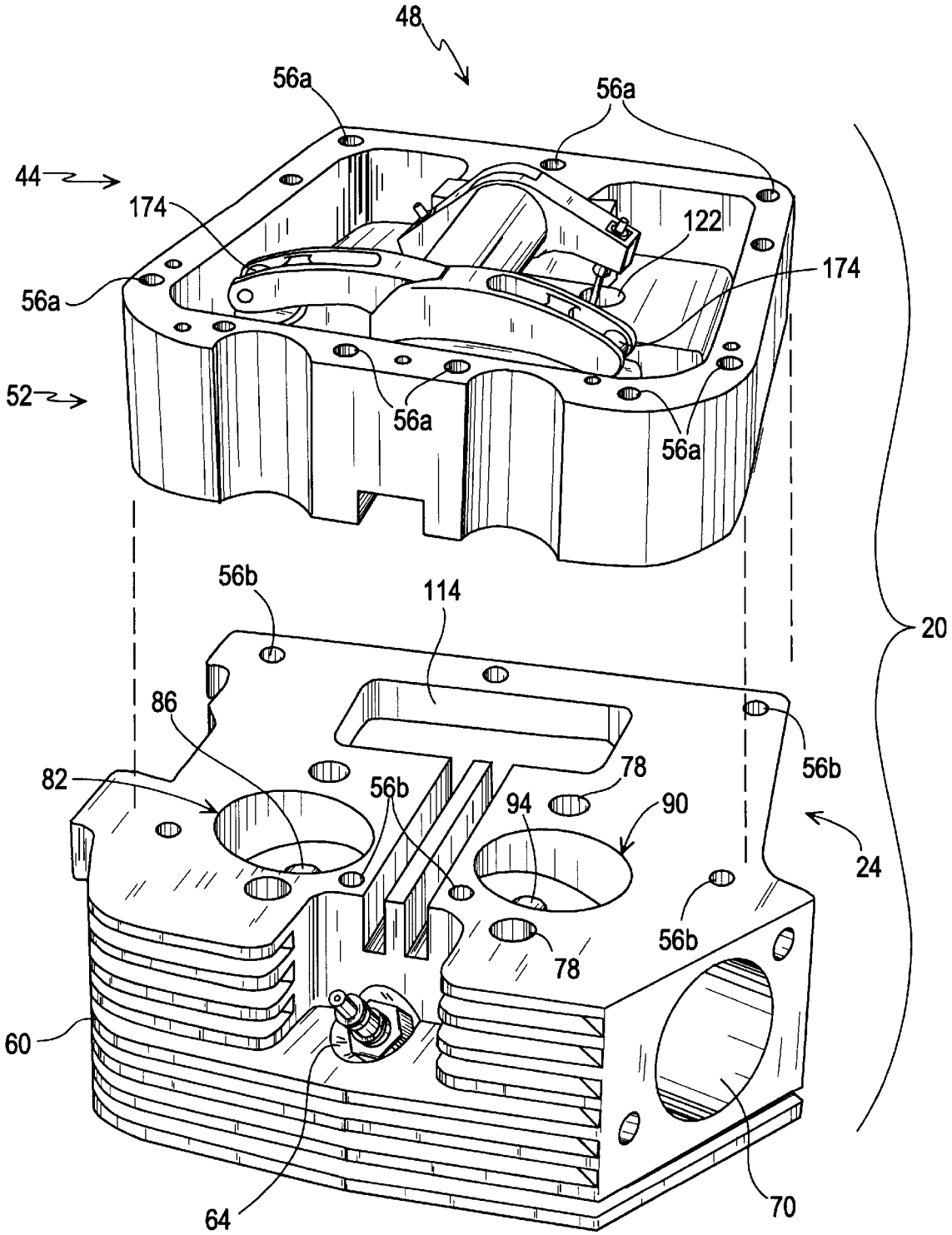
FIG. 7 is another perspective view of the present invention, wherein further detail of the cylinder head 24 is shown.

FIG. 1 shows a perspective view of the novel internal combustion engine head assembly 20. FIG. 2 shows a top view with indicated cross-sectioning planes for the cross sections of FIG. 8. The head assembly 20 (FIG. 1) includes a cylinder head 24 which is securely mounted to engine block 28 (shown in FIG. 8) in a manner whereby an internal combustion engine cylinder 32 (FIG. 8) having a cylinder wall 36 has its open end enclosed by the cylinder head 24. A recessed combustion chamber 40 (FIG. 8) aligns with the open end of the cylinder 32 for providing, e.g., intake and exhaust valve clearances as one skilled in the art will appreciate and as is described in further detail hereinbelow. The internal combustion engine head assembly 20 also includes a valve train subassembly 44 which, in turn, includes a rocker arm assembly 48 providing a novel rocker arm configuration for actuating the fuel intake and exhaust valves as will be described further hereinbelow. Additionally, the valve train subassembly 44 also includes a rocker arm housing 52 for containing the rocker arm assembly 48. Note that the rocker arm housing 52 is separable from the cylinder head 24 as shown in FIG. 7. In particular, bolts (not shown) provided in housing securing bores 56*a* secure the valve train subassembly 44 to the cylinder head 24. However, it is an aspect of the present invention that, at least in some embodiments, different embodiments of the cylinder head 24 and the valve train subassembly 44 may be secured together as long as the housing securing bores 56*a* align with the housing securing bores 56*b* provided within the cylinder head 24 (FIG. 7).

To describe the cylinder head 24 in more detail, reference is made to FIGS. 1, 3, 7 and 8. The embodiment of the cylinder head 24 (and more generally the internal combustion engine head assembly 20) is for an air cooled internal combustion engine such as a four or two stroke motorcycle engine, and more particularly, a Harley-Davidson engine such as is provided on Harley-Davidson Sportster and Harley-Davidson Big Twin motorcycles. The cylinder head 24 (as best shown in FIG. 7) includes heat dissipating fins 60, spark plug socket 64 for threadably securing a spark plug 66 (for use in igniting fuel vapors within the cylinder 32 and the combustion chamber 40, see FIG. 8), an intake port 70 for directing fuel vapors toward the cylinder 32, an exhaust port 74 (FIG. 8) for directing exhaust out of the cylinder 32, head securing bores 78 wherein threaded bolts (not shown) are used for securing the cylinder head 24 to the engine block 28, exhaust valve recess 82 having an exhaust valve stem channel 86 (FIGS. 7 and 8) provided therein and traversing further through a thickness of the cylinder head , an intake valve recess 90 having an intake valve stem channel 94 also provided through a thickness of the cylinder head 24, wherein the valve recesses 82 and 90 together with their respective stem channels 86 and 94 are used both for: (a) securing, respectively, the exhaust and intake valve stem assemblies 98 and 104, and (b) providing a channel for the valve stem assemblies to communicate rocker arm assembly 48 movements to the exhaust and intake valves 106 and 110, respectively, as one skilled in the art will understand. Additionally, the cylinder head 24 also includes a push rod cutout 114 (FIGS. 3 and 7) that allows the push rods 118 (one of which is shown in FIG. 1) to extend from the engine block 28 through the push rod cutout 114 for actuating the rocker arm assembly 48 of the valve train subassembly 44. In particular, the push rod cutout 114 is part of an intermediate passageway for the exhaust and intake push rods 118 so that these push rods can extend from the valve lifters (not shown) of the engine block 28 to the rocker arm assembly 48. Thus, in addition to the push rods traversing cutout 114, they also pass through the rocker arm housing 52 via push rod insert bores 122 and 126 (FIGS. 1 and 3) to contact the exhaust and intake push rod arms 134 and 146 as described hereinbelow. Note that the push rod cutout 114 is sufficiently large to accommodate a plurality of push rod orientations that may be provided by, for example, various engine blocks 28 embodiments upon which the cylinder head 24 can be mounted. In particular, since the cylinder head 24 of the present embodiment can be bolted onto both a Harley-Davidson Sportster motorcycle and a Harley-Davidson Big Twin motorcycle, the push rod cutout 114 is sufficiently large to accommodate the different orientations of the push rods between the Sportster Harley-Davidson Sportster engine and the Harley-Davidson Big Twin engine. Thus, by only changing the embodiment of the valve train subassembly 44, the present invention can be utilized with either of the Harley-Davidson Sportster motorcycles and the Harley-Davidson Big Twin motorcycles.

Referring now to the components of the valve train subassembly 44 (FIG. 2), this subassembly includes the rocker arm housing 52, the rocker arm assembly 48, and threaded bolts 130 for securing the rocker arm assembly to the rocker arm housing.

Figure 4:
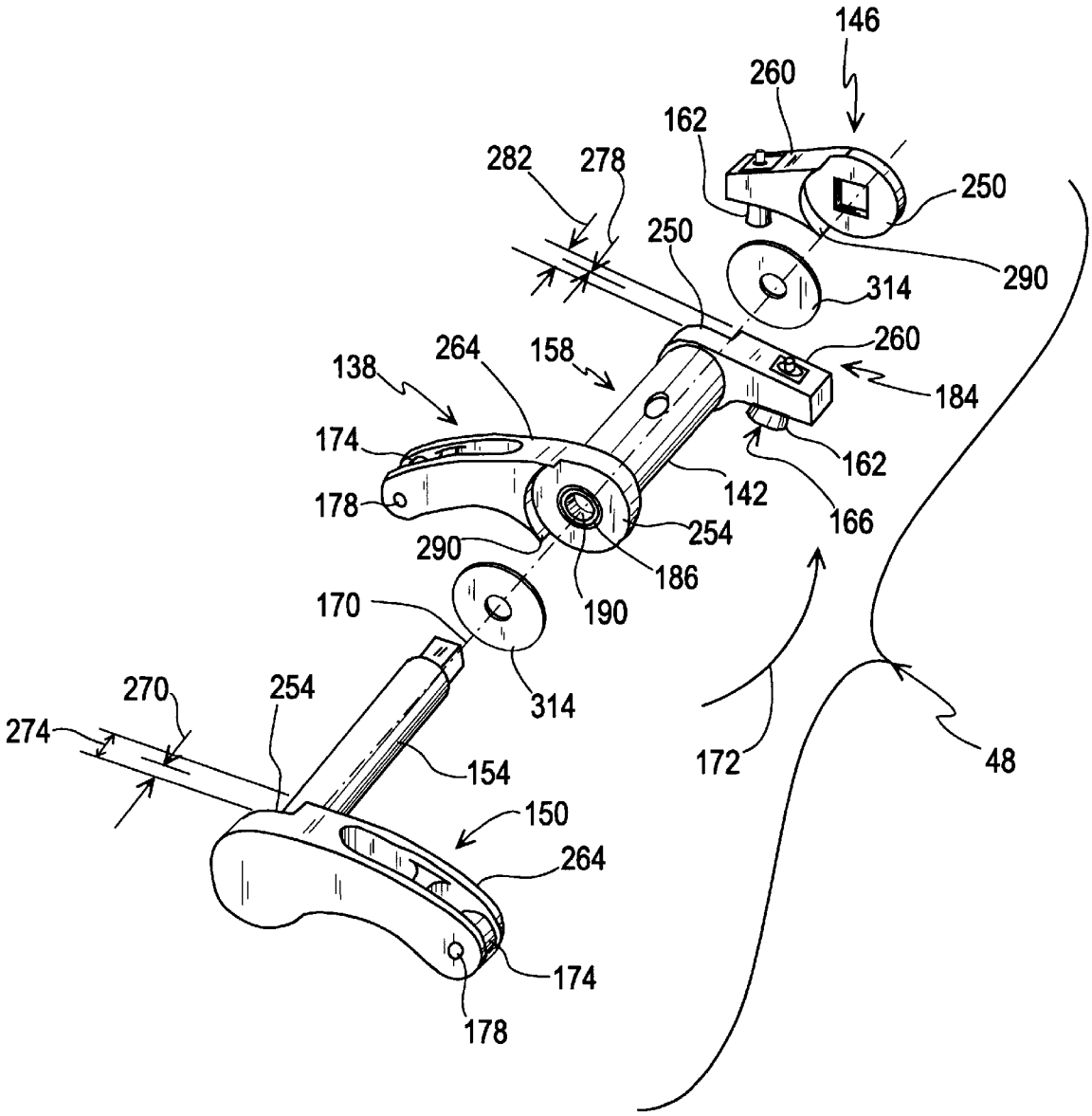
FIG. 4 is an exploded view of the rocker arm assembly 48 of the present invention.

The novel rocker arm assembly 48 is shown from various perspectives in FIGS. 1, 2, 4, and 7. Referring initially to FIGS. 2 and 4, the rocker arm assembly 48 includes: (a) an exhaust rocker arm 158 having an exhaust push rod arm 134 that is capable of being biased by the exhaust push rod 118 (b), an exhaust valve arm 138 for biasing the exhaust valve 106 (FIG. 8) into an open position for expelling exhaust from the cylinder 32 into the exhaust port 74, and (c) an exhaust rocker arm connector 142 for connecting the exhaust push rod arm 134 to the exhaust valve arm 138 so that there is a transfer of biasing forces between the two arms as will be described further hereinbelow. Additionally, the rocker arm assembly 48 includes an intake rocker arm assembly having: (a) an intake push rod arm 146 that is capable of being biased by an intake push rod 118, (b) an intake valve arm 150 for biasing intake valve 110 (FIG. 8) to an open position for allowing fuel vapors to be drawn into the cylinder 32, and (c) an intake rocker arm connector 154 that traverses an interior passageway through the exhaust rocker arm connector 142 for connecting the intake push rod arm 146 with the intake valve arm 150 for transmitting valve actuating forces between the two intake arms.

Referring now to the exploded view of the rocker arm assembly 48 in FIG. 4, the exhaust rocker arm assembly 158 is shown as a single unitary assembly through which the intake rocker arm connector 154 is inserted when the rocker arm assembly 48 is assembled.

Figure 8:
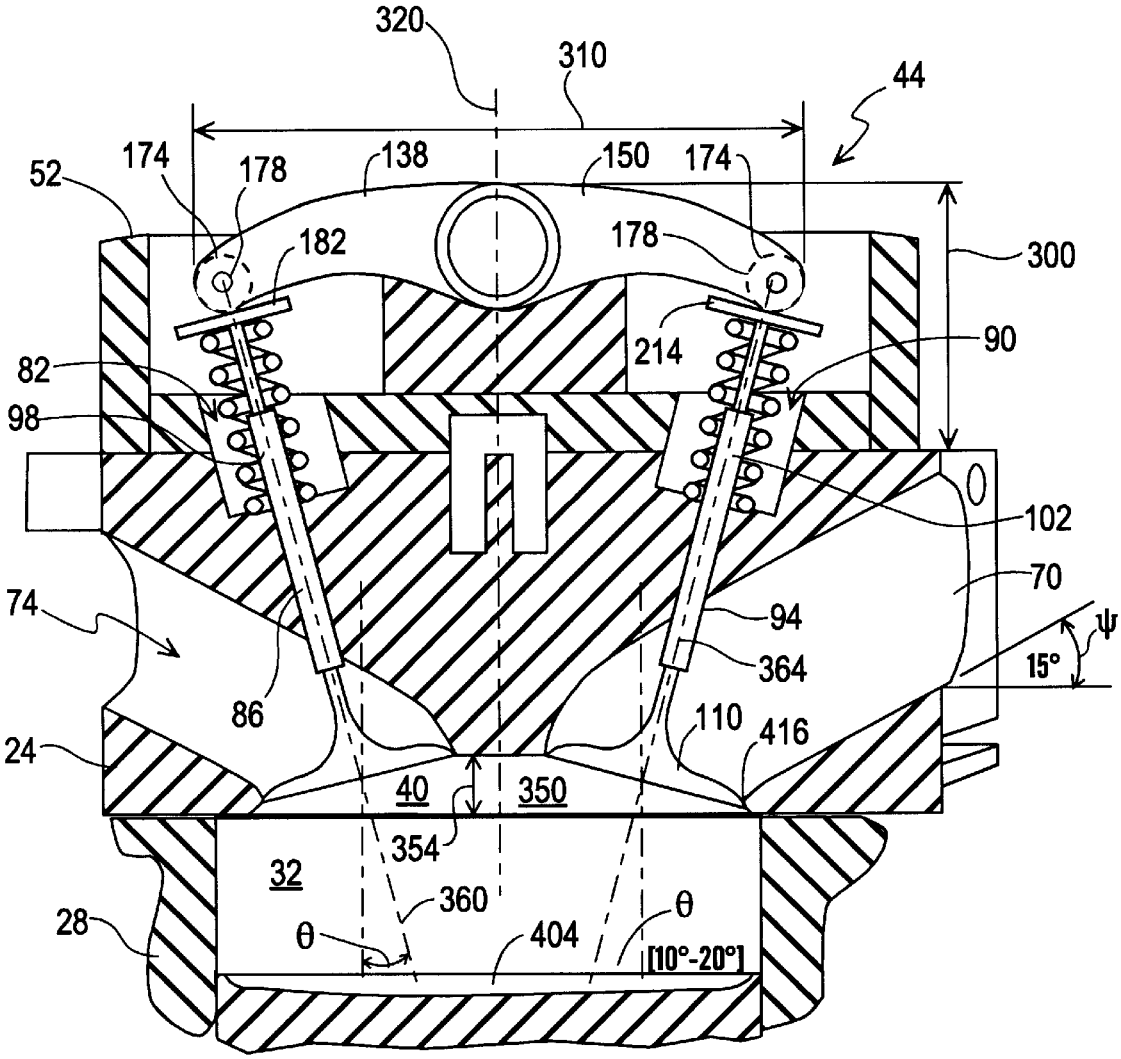
FIG. 8 is a cross-section of the internal combustion engine head assembly 20 according to the sectioning planes shown in FIG. 2.
Figure 9:
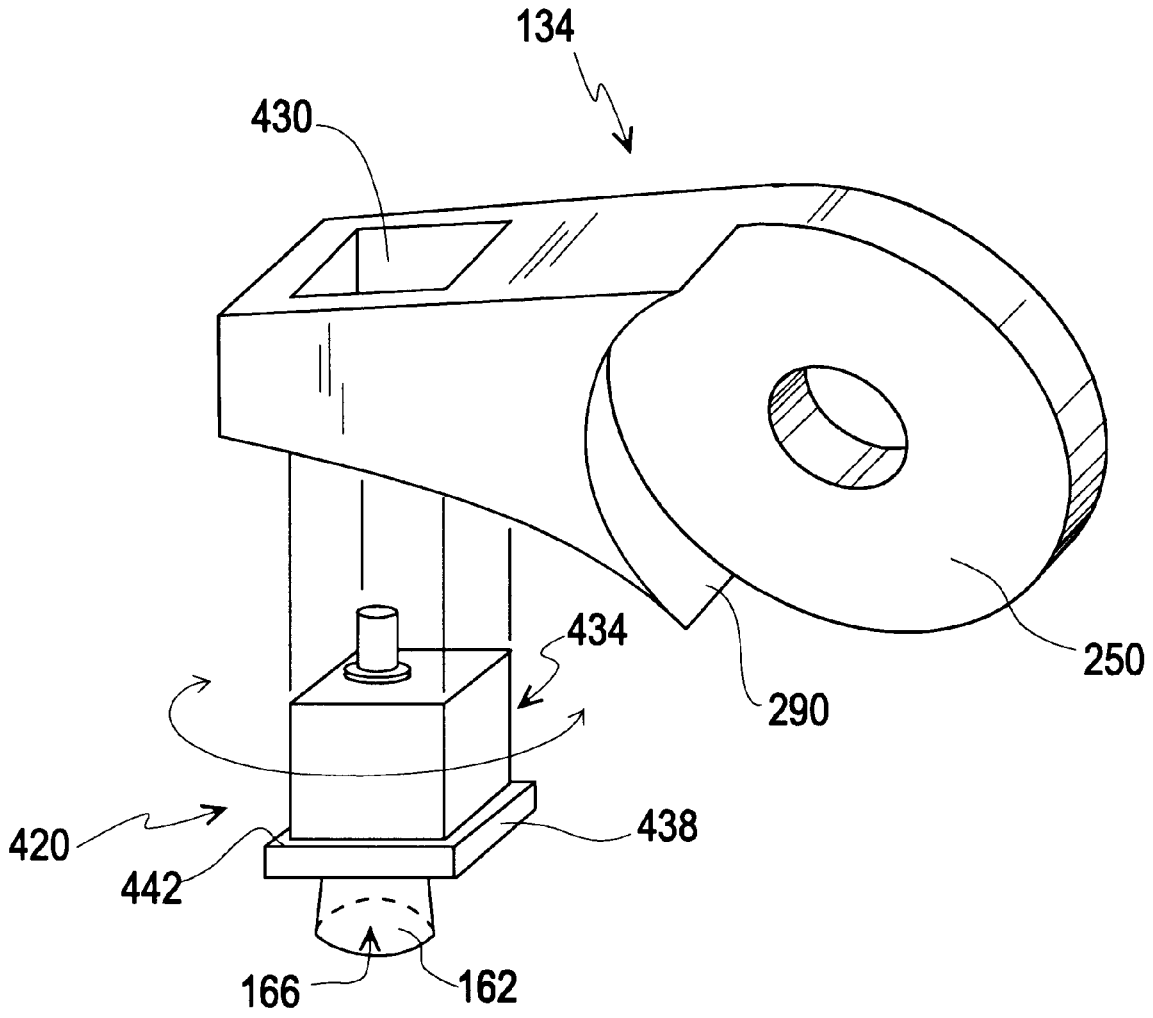
FIG. 9 shows a perspective view of the exhaust push rod arm 134 and the rocker arm insert 420 that is slidably received within the slot 430.

Referring now to the exhaust push rod arm 134, this figure (as well as FIG. 9) shows that the exhaust push rod arm 134 includes a push rod socket 162 having a concave face 166 (indicated in both FIGS. 4 and 9.) This concave face 166 mates with an end of the exhaust push rod 118 for providing a torque about the axis 170 of the exhaust rocker arm connector in the direction indicated by the arrow 172. Accordingly, when the rotation according to arrow 172 occurs, the exhaust valve arm 138 also rotates in the same direction about the axis 170 thereby causing a roller bearing 174 that is journaled onto a shaft 178 so that the roller bearing can actuate the exhaust valve assembly 98 by rolling upon a contact surface 182 (FIG. 8). Note that additionally, the exhaust rocker arm 158 also includes bearings 186 that are pressed onto the interior surface of the exhaust rocker arm connector 142 at each end of this connector along its extent in the direction of axis 70. Thus, when the intake rocker arm connector 154 is inserted into the exhaust rocker arm connector 142, the connector 154 snugly fits within the inner cylindrical surface 190 of the bearing rings 186, thereby supporting the exhaust rocker arm 158 on the connector 154 so that each of the exhaust and intake rocker arms can oscillate about the axis 170 independently during operation of the engine having the novel internal combustion engine head assembly 20 of the present invention.

Note that the intake connector 154 is the support shaft upon which the rocker arm assembly 48 is supported between the rocker arm collars 192 and 194. That is, the extension 198 of the connector 154 is tightly fitted within the annular opening 202 having a surrounding bearing 206 of caged needle bearings, and the opposite end of the connector 154 is tightly fitted within the corresponding annular opening 210 of the rocker arm collar 194 which also has an annular bearing 206 of caged needle bearings.

Note that the intake rocker arm, as previously discussed, includes intake push rod arm 146 that is substantially a duplicate of the exhaust push rod arm 134. Accordingly, the intake push rod arm 146 includes a push rod socket 162 substantially identical to the one in exhaust push rod arm 134. Additionally, note that the intake valve arm 150 is substantially a duplicate of the exhaust valve arm 138. Thus, in particular, the intake valve arm 150 includes a roller bearing 174 that is journaled upon a shaft 178 such that the roller bearing 174 rolls on the contact surface 214 of the intake valve assembly 102 (FIG. 8).

Accordingly, as can be seen from FIG. 4, each of the push rod arms and the valve arms has a pivot part 250, and each of the valve arms has a pivot part 254, wherein these pivot parts stabilize their respective arms for pivoting about the axis 170. Additionally, each of the push rod arms 134 and 146 includes an integral arm part 260, and each of the valve arms 138 and 150 includes an arm part 264. Further, note that for each arm part and the pivot part to which it is mounted, the width of the pivot part is approximately less than half the width of the arm part. For example, for each of the valve arms 138 and 150 of the embodiment of FIG. 4, the width of their corresponding pivot parts 270 is just under half the width 274 of the valve arm part. Similarly, regarding the push rod arms 134 and 146, the width 278 of each pivot part 250 is less than half the width 282 of each arm part. Thus, since the pivot parts 250 and 254 have their widths 270 and 278 offset along the arm part widths 274 and 282, each of the push rod arms and the valve arms has an arcuate overhang 290 with a width somewhat greater than the corresponding width of the adjacently positioned pivot part. Thus, by mating together the valve arms 138 and 150 and correspondingly mating together the push rod arms 134 and 146, each of the arcuate overhangs 290 is adjacent to and surrounds a portion of the width of the pivot part of the mating (valve or push rod) arm. Note that for the present embodiment of the invention, the configuration of the rocker arm assembly 48 provides the advantages discussed hereinbelow.

The rocker arm assembly 48 is very compact and therefore can be employed in spaces that are relatively small in comparison to spaces required for conventional rocker arm assemblies. For example, when providing the internal combustion head assembly 20 on a Harley-Davidson Sportster or Big Twin, the valve train subassembly height 300 (FIG. 8) must be less than 3 inches so that once a cover is provided on the rocker arm housing 52 to enclose the rocker arm assembly 48, the distance in the direction of the arrow 300 corresponding to a height preferably should straightforwardly fit within the space underneath the gas tank of such motorcycles. Further, by transferring the biasing forces generated by, e.g., the push rods 118, from each of the push rod arms to its corresponding valve arm via concentric connectors 154 and 142, the width 310 of the rocker arm assembly 48 (FIG. 8) is reduced from that of rocker arm assemblies that have non-concentric portions. Additionally, note that by having the valve arms 138 and 150 mated together as shown in the embodiment of the invention provided by the figures herein, there is a further reduction in the width 310. Thus, in the embodiment illustrated in the present figures for a Harley-Davidson Sportster or Big Twin head assembly, the width 310 is approximately 4.180 inches.

Another advantage of the configuration of the rocker arm assembly 48 provided herein is that each of the pairs of mated valve arms and mated push rod arms provides mutual support for one another. That is, by having a heavy duty thrust washer 314 between the mating valve arms and the mating push rod arms, and by tightly securing the pivot parts of the mating arms against the intervening thresh washer 314, each of the valve arms 138 and 150, and the push rod arms 134 and 146, have a mutually reinforcing arm that assists in maintaining the orientation of the arm about the axis 170. Thus, there is a reduced risk of the valve and/or push rod arms from misaligning or bending from their desired orientation about the axis 170 during strenuous engine operation. More precisely, since the pivot parts are not aligned with the center portion of the widths of the arm parts, operational forces can potentially be generated that tend to move the valve and push rod arms (or the free end portions thereof) in directions having a non-negligible force component that is substantially parallel to the axis 170. Such movement, of course, would tend to decrease the operational longevity of the rocker arm assembly. Accordingly, much of this difficulty is alleviated in the present configuration in that the mating valve arms and mating push rod arms provide mutual aligning support to reinforce alignment about the axis 170.

Additionally, note that the valve arms 138 and 150, and the push rod arms 134 and 146 are normal to the axis 170. As an example of what is meant by normal, the following geometrical relationships for each one of the valve arms 138 and 150 holds. Given a center point, c, of the contact area between the roller bearing 174 of the valve arm and the contacting contact surface (one of 182 and 214, FIG. 8), the line, $L_0$, between c and a point x on the axis 170 such that x provides the shortest distance between c and the axis can be defined. Moreover, a plane, P, can then be defined as including this line, $L_0$, wherein P is normal to the axis 170. Define a line segment, $L_1$, between the point x and the center of mass of the arm part 264 of this valve arm. If $L_1$ is substantially in the plane, P, then the valve arm may be said to be "normal" to the axis 170. Note that a similar geometrical interpretation can be provided for the other valve arm as well as the push rod arms 134 and 146. In particular, for the push rod arms, the center point, c, of the contact area is a central point of push rod contact within the concave portion of the push rod socket for seating with an end of a push rod 118.

Additionally note that the planes defined immediately above for each of the mating valve arms 138 and 150 are substantially parallel and, in fact, substantially coplanar (with a maximum distance between such planes being approximately 0.030 inches. Accordingly, such mating valve arms can be said to be substantially in line with one another. In the present embodiment, such in-lineness of mating valve arms facilitates the compactness of the rocker arm assembly 48 in that when assembled, the length of the rocker arm assembly along the axis 170 can be reduced from that of alternative rocker arm assembly embodiments wherein these planes are not substantially coplanar. Note that such in-lineness is of further benefit in the present embodiment since the valve assemblies 98 and 102 (FIGS. 2 and 8) are substantially mirror images of one another about the plane defined by the axis 170 (FIG. 2) and the axis 320 (FIG. 8). Further, a similar statement can be made about the orientations of the push rods 118 that have ends seated within the push rod sockets 162 of the push rod arms 134 and 146. Thus, the in-lineness of the mating push rod arms further contributes to the compactness of the rocker arm assembly 48 along the axis 170.

One of the primary motivations for the novel rocker arm assembly 48 is due to the particular constraints imposed by the engineering of the Harley-Davidson Sportster and Big Twin motorcycles. In particular, a motivation for the present invention comes from a desire to enhance both the performance and the fuel efficiency of such motorcycles while at the same time reducing the exhaust pollutants presently created by such motorcycles. To realize such enhancements within the constraints imposed by the dimensions of both the Harley-Davidson Sportster and Big Twin engine blocks as well as the non-engine constraints (e.g., motorcycle frame, gas tank, etc.), the engine head assembly 20 of the present invention: (a) provides valve assembly angles that enhance stock engine performance, (b) provides intake and exhaust port configurations that also enhance engine performance, and (c) provides an enhanced combustion chamber 40 that also enhances engine performance. Moreover, the changes (a)–(c) immediately above provide synergistic effects for substantially enhancing the performance of these engines.

There are two fundamental criteria that motivated the design of the present invention. A first criteria was to improve the compression ratio of internal combustion engines (e.g., Harley-Davidson engines) for obtaining better performance. Note that such engines typically have their exhaust and intake valve assemblies tilted in a range of approximately 35° to 45° from the central axis of the cylinder 32 to which these valve assemblies are associated. Thus, as can be appreciated by those skilled in the art, the volume of that portion of the combustion chamber 40 within the cylinder head 24 (this volume hereinafter denoted by the label 350, FIG. 8, is greater due to the tilt of the exhaust and valve faces. In particular, this typically translates into head clearance 354 substantially greater than that shown in FIG. 8. More particularly, stock Harley-Davidson Sportster and Big Twin engines typically have a head clearance of approximately 1.4 inches, whereas an embodiment of the present invention for such engines has a head clearance of approximately 0.650 inches. Thus, since the volume 350 is less, higher compression ratios can be achieved with the present invention. For example, stock Harley-Davidson Sportster and Big Twin compression ratios are in the range of 8.0 to 8.5, whereas embodiments of the present invention can achieve compression ratios in the range of 9.5 to 14.7 for these same engines (albeit modified according to the present invention). As can be seen from FIG. 8, by rotating the valve assemblies 98 and 102 further towards the vertical, the head clearance 354 can be substantially reduced. More precisely, for each of the longitudinal axes 360 and 364 of the exhaust and intake valve assemblies 98 and 102, respectively, it has been determined that when the angle θ between the longitudinal axis and the corresponding axis parallel with axis 320 is approximately 10 to 20°, a substantially higher performance can be obtained.

More preferably, it has been determined that for the Harley-Davidson Sportster and Big Twin engines having cylinder volumes of 600 cc and 670 cc, respectively, and strokes of 3.812 inches to 5 inches, a range of 11° to 16° is preferable. Accordingly, such a decrease in the angle θ from the Harley-Davidson stock engines requires a more compact rocker arm assembly 48 in that the total height above the engine block 28 that can be utilized and still fit within the typical frame and gas tank of a Harley-Davidson is only 6.5 inches. Thus, this necessitates that the width 310 (FIG. 8) of the rocker arm assembly 48 be preferably less than 5 inches, and more preferably between 4 inches and 4.5 inches. As one skilled in the art will understand, it is very difficult to provide an intake rocker arm assembly and an exhaust rocker arm assembly for engines having cylinder bores of 3.498 inches (as the Sportster and Big Twins have), wherein such rocker arm assemblies are to be provided within a space having interior dimensions of approximately no more than 6.375 inches×2.00 inches×3.560 inches with an included angle of approximately 30° between the longitudinal axes 360, 364 of the exhaust and intake valve assemblies, respectively. In fact, it is believed impossible to provide such a rocker arm assembly 48 within such a restricted space without providing parallel portions for the exhaust and intake rocker arms that oscillate about one another such as rocker arm connectors 142 and 154 together with mutually reinforcing pairs of push rod arms 134 and 146, and/or valve arms 138 and 150.

Figure 3:
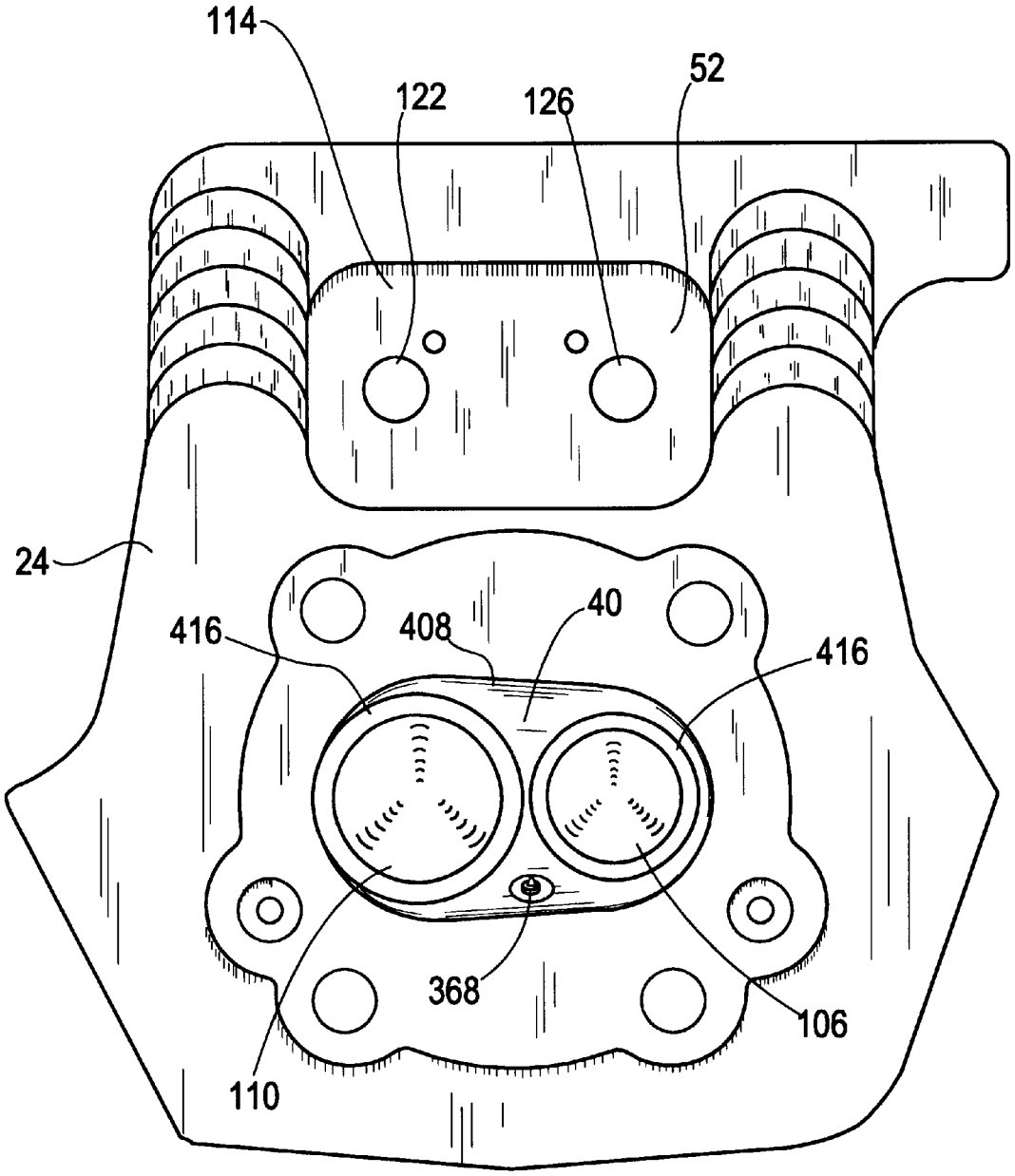
FIG. 3 is a bottom view of the occluded (in FIG. 1) portions of the present invention.
Figure 5:
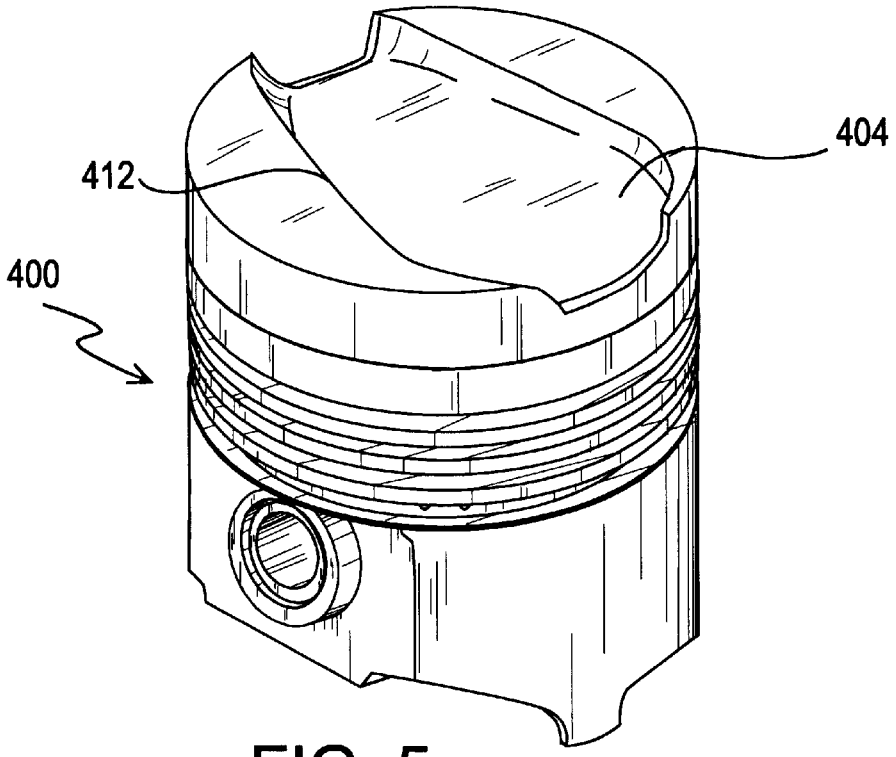
FIG. 5 shows a piston 400 having a configuration compatible with the operation of the cylinder head 24 of the present invention.

Note that an additional view of the combustion chamber 40 is provided in FIG. 3. This figure shows the relative sizes of the valve faces for the exhaust and intake valves 106 and 110, respectively. Further, note that the spark plug ignition element 368 is substantially centrally located between the valve faces for providing a uniformly distributed flame front during ignition within the cylinder 32. Further, note that the novel design of a piston 400 (FIG. 5) for the present invention is designed to cooperate with the combustion chamber 40 configuration for providing the low head clearance 354 (FIG. 8). In particular, note that the piston 400 has a concave recess 404 that is substantially a mirror image of the combustion chamber 40 so that the egg-shaped boundary 408 of the combustion chamber 40 and the egg-shaped profile boundary 412 are oriented so as to substantially mate together when the piston 400 is at top dead center of the cylinder 32. The concave recess 404 provides a number of advantages when used in combination with the cylinder head 24 of the present invention. For example, since the concave recess 404 matches the profile of the combustion chamber 40, the valve faces of the valves 106 and 110 can have their outside rim portions 416 closest to the engine block 28 closer than the distance needed to open the valves since the valves 106 and 110 can open into the concave recess 404 of the piston 400. Further, note that since the configuration of the piston and the cylinder head 24 is such that as the piston approaches top dead center, the volume within the piston decreases at a sufficient rate to produce a pressure spike of approximately 140 psi at 9.5 to 1 compression just before the cylinder reaches top dead center. Note that this has an advantageous affect on combustion within the cylinder 32 in that the compressed fuel during an ignition cycle is compressed sufficiently so that it atomizes and thereby provides a substantially uniform mixture that enhances the speed of the flame front upon ignition by the spark plug ignition element 368.

It is an additional aspect of the present invention that the intake port 70 and the exhaust port 74 are substantially straighter than the intake and exhaust ports typically provided on Harley-Davidson Sportster and Big Twin engines. Accordingly, this has the advantage of providing substantially better flow through to and from the cylinder 32 for fuel vapor intake and exhaust exit. Thus, it is an aspect of the present invention that the exhaust system of an engine having the cylinder head 24 can be better tuned as one skilled in the art will understand. As can be seen in FIGS. 2 and 8, the present intake and exhaust ports each have a three-dimensional curvature. Such a curvature facilitates a swirling of the fuel vapors entering the cylinder 32 thereby more thoroughly mixing fuel droplets with air. In particular, the intake and exhaust ports have an angled bend within each of them in the plane of FIG. 2, wherein the angle (labeled γ) is approximately 28°. Additionally, these ports also have an angled bend in the plane of FIG. 8, wherein the angle (labeled ψ) is approximately 15°.

Note that the swirling action in the intake port 70 facilitates mixing of the fuel and air both in the port and as the fuel enters the cylinder 32. That is, when the intake valve 110 is open, the swirling action on the intake port is carried on into the volume of the cylinder 32 and the combustion chamber 40. Further, such swirling is also enhanced by the mirrored shape of the combustion chamber and the piston head having the concave recess 404 contoured into its surface. Note that such turbulence contributes to a better burning of the fuel vapor mixture and thereby causes the engine to be cleaner burning with fewer pollutants being generated in the exhaust gases.

Figure 6:
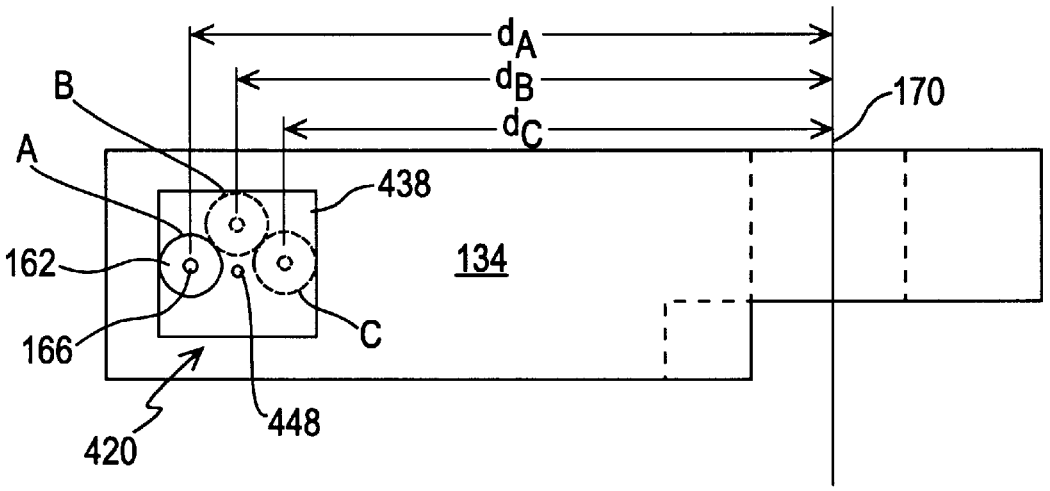
FIG. 6 is a view of the exhaust push rod arm 134 illustrating the various configurations by which a rocker arm insert 420 can be positioned therein.

In a related aspect of the present invention, the rocker arm assembly 48 has been configured so that for each one of the exhaust rocker arm 158 and the intake rocker arm, the length, d, from a center point of the push rod socket 162 of the included push rod arm to the axis 170 can be varied. Accordingly, this implies that the ratio of:

a) the distance y between (i) where the roller bearing 74, included within the rocker arm, contacts one of the contact surfaces (182, 214, FIG. 8), and (ii) the axis 170, and (b) the length d can be varied between 1.5 and 1.7. An example of how such changes in these ratios can be embodied is illustrated shown in FIGS. 6 and 9. In these figures, a rocker arm insert 420 is shown, wherein this rocker arm insert is capable of snugly fitting into the slot 430. In particular, the rocker arm insert 420 includes a rectangular parallelopiped portion 434 for snugly fitting within the slot 430 and thereby maintaining an orientation of the rocker arm insert within this slot. The parallelopiped portion 434 is connected to a base 438 that provides a shelf 442 for preventing the rocker arm insert 420 from sliding through the slot 430 in that this shelf has an extent that will not fit through the slot 430. Additionally, on the opposite side of the base 438, a push rod socket 162 is attached. Note that this push rod socket is attached at an offset from a center of the base 438, as can be best seen in FIG. 6. The push rod socket 162 is offset from a center point 448 so that when the rocker arm insert 420 is inserted into the slot 430 in one of the three orientations A, B, C shown in FIG. 6, their corresponding distances $d_A$, $d_B$, and $d_C$ from the center point of the concave face 166 of the push rod socket to the axis 170 is different. In fact, this difference is sufficient to change the ratio of: (a) the length y for a valve arm (138 or 150) to (b) the corresponding distance $d_i$, i=A, B or C (FIG. 6), so that this ratio becomes 1.5, 1.6 and 1.7 as $d_i$ increases. Additionally, note that such a rocker arm insert 420 and a corresponding mating slot 430 can be provided for both the exhaust push rod arm 134 and the intake push rod arm 146 so that the ratios of both exhaust and intake rocker arms can be similarly varied between the three values 1.5, 1.6 and 1.7. Thus, as one skilled in the art will appreciate, the rocker arm assembly 48 can be tuned for various types of engine performance depending on the valve arm to push rod arm ratios provided on the intake and exhaust rocker arms.

Figure 10:
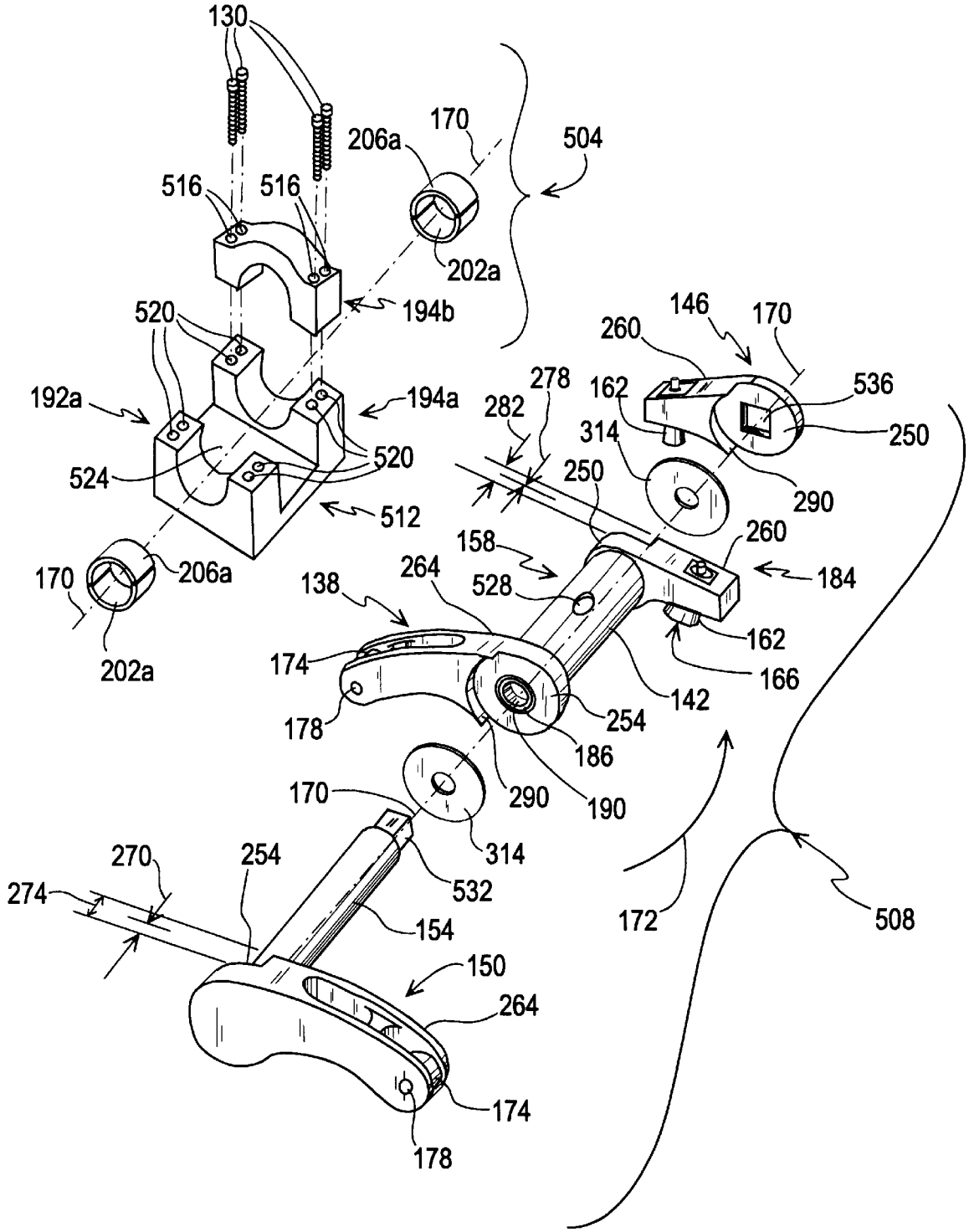
FIG. 10 is an exploded view of an alternative embodiment of the present invention.
Figure 11:
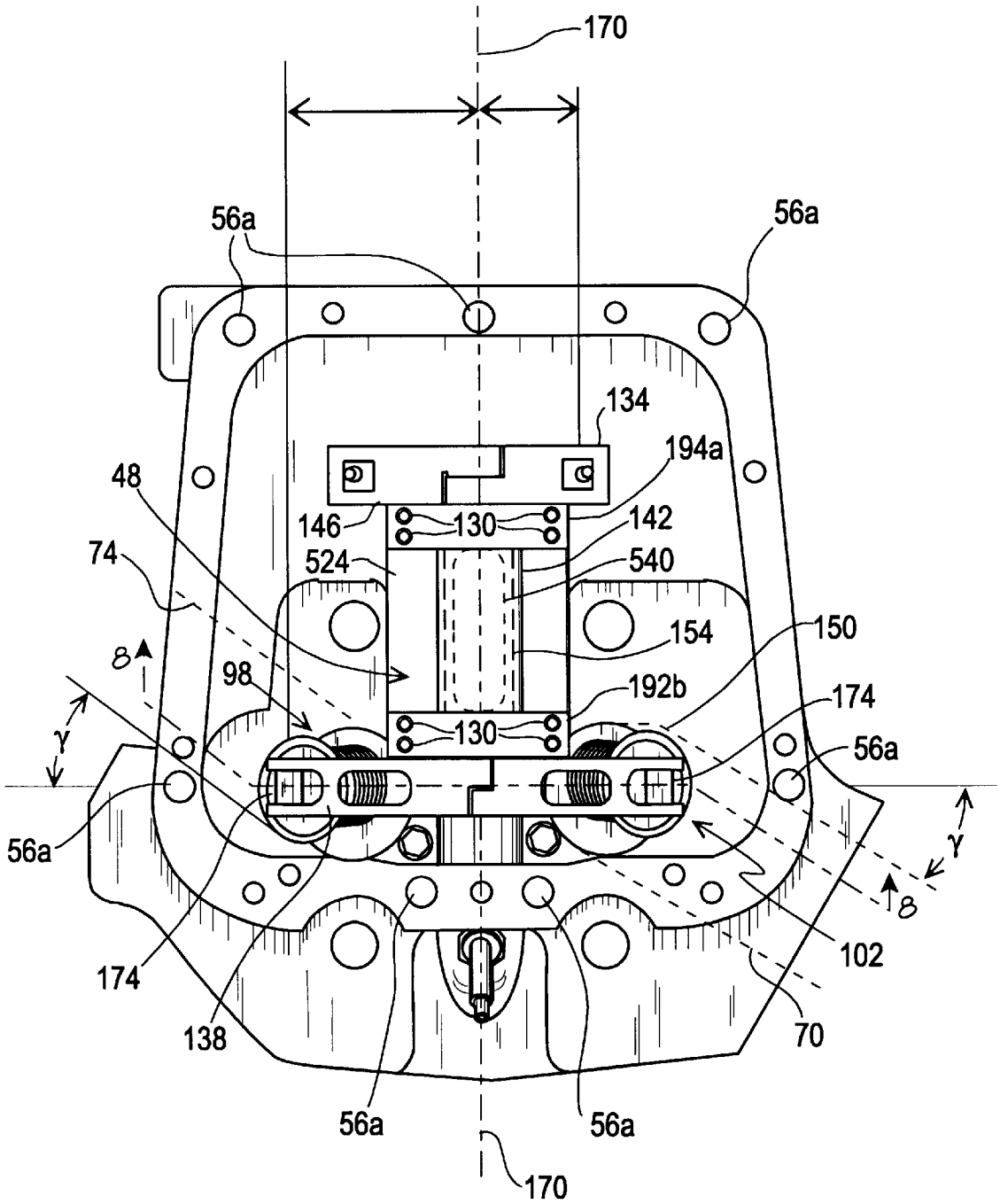
FIG. 11 is a plan view of the alternative embodiment also shown in FIG. 10.

An alternative embodiment of the present invention is also shown in FIGS. 10 and 11. Referring now to FIG. 10, it can be seen that the collar arms 190 and 194 as disclosed in FIG. 4 have been replaced by a mounting bracket 504 into which the rocker arm subassembly 508 is provided for support. In particular, the mounting bracket 504 supports that exhaust rocker arm connector 142 between a lower mount 512 and two upper mounts (only one of which is shown in FIG. 10) 192*b* and 194*b*, wherein the exhaust rocker arm connector 142 fits therebetween and is aligned according to the matching of the two instances of the axis 170 in the exploded mounting bracket 504 portion and the exploded rocker arm subassembly 508 portion. Accordingly, there are threaded bolts 130 which fit through the bores 516 of each of substantially identical rocker arm collars 192*a* and 194*a* (only 194*a* being shown in FIG. 10, but both of which are shown in FIG. 11), wherein the bolts 130 also thread into the lower mount 512 via bores 520. In particular, the bolts 130 are threadably received in the bores 520 in the lower mount and extend through lower rocker arm collar portions 192*a* and 194*a* for securing mounting bracket assembly 504 to the rocker arm housing 52. Further, note that bearings 206*a* are provided in the circular enclosure produced by the mating of lower rocker arm collar portion 192*a* with upper rocker arm portion 192*b*, and the mating of lower rocker arm portion 194*a* with upper rocker arm portion 194*b*. Moreover, the par of bearings 206*a* are secured about the exhaust rocker arm connector 142, thereby maintaining the rocker arm subassembly 508 in position with rocking about the axis 170. That is, the exhaust rocker arm 158 fits through the interiors 202*a* of each of the bearings 206*a*, and thereby is able to pivot about the axis 170. Note that it is an advantage of the present embodiment that the length along the axis 170 is shorter than the previous embodiment shown in FIG. 2. Further note that the bearings 206*a* are larger than the bearings 206 (FIG. 4) of this pervious embodiment. Accordingly, more durable bearing can be used for bearings 206*a*.

Also of note with regard to this new embodiment, the exhaust rocker arm connector 142 includes an oil hole for thereby allowing oil to more easily lubricate the interior components of the rocker arm subassembly 508. Further, note that the connector 154 now includes a squared-off connector end 532. Accordingly, when the present invention is fully assembled, this connector end 532 fits matingly through the matching square hole 536.

Referring now to FIG. 11, the present alternative embodiment is shown fully assembled from a plan view. Note that although not shown in this view, the base portion 524 rests upon a pedestal portion of the rocker arm housing 52 immediately underneath the base portion 524. Additionally, note that the pedestal portion includes a recess 540 which is used as an oil drain.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiments described hereinabove are further intended to explain the best mode presently known of practicing the invention and to enable others skilled in the art to utilize the invention as such, or in other embodiments, and with the various modifications required by the particular application or uses of the invention. It is intended that the appended claims be construed to include alternative embodiments to the extent permitted by the prior art.

What is claimed is:

1. A valve train assembly for actuating valves of an engine, comprising;

an intake force receiving portion for receiving a related intake biasing force for inducing a change in an actuation of an intake valve;

an intake force transmitting portion, operably connected to said intake force receiving portion, for transmitting a related intake valve actuation change force to the intake valve when said intake force receiving portion receives the intake biasing force;

an exhaust force receiving portion for receiving a related exhaust biasing force for inducing a change in an actuation of an exhaust valve;

an exhaust force transmitting portion, operably connected to said exhaust force receiving portion, for transmitting a related exhaust valve actuation change force to the exhaust valve when said exhaust force receiving portion receives the exhaust biasing force;

wherein a first portion of said valve train assembly includes one of said intake force receiving portion and said intake force transmitting portion, and wherein a second portion includes one of said exhaust force receiving portion and said exhaust force transmission portion, said fist and second portions are related as follows:

(A1) for each of said first and second portions, te portion includes a pivot part and an arm part joined together, wherein said pivot part is disposed about a corresponding pivot axis for the portion, and said arm part has a length extending from the joining together of said pivot and arm parts to a force transfer subpart of said arm part that transfers said related force between said arm part and another component of the engine;

(A2) for said first and second portion at least one of the following holds:

(i) each of said lengths of said arms of the first mad second portions is substantially normal to said corresponding pivot axis for each portion;

(ii) said lengths of said arms are substantially in line;

wherein said corresponding pivot axes for said first and second portions are coincident.

2. A valve train assembly for actuating valves of an engine, comprising:

an intake force receiving portion for receiving related intake biasing force for inducing a change in an actuation of an intake valve;

an intake force transmitting portion, operably connected to said intake force receiving portion, for transmitting a related intake valve actuation change force to the intake valve when said intake force receiving portion receives the intake biasing force;

an exhaust force receiving portion for receiving a related exhaust biasing force for inducing a change in an actuation of an exhaust valve;

an exhaust force transmitting portion, operably connected to said exhaust force receiving portion, for transmitting a related exhaust valve actuation charge force to the exhaust valve when said exhaust force receiving portion receives the exhaust biasing force;

wherein a first portion of said valve train assembly includes one of said intake force receiving portion and said intake force transmitting portion, and wherein a second portion includes one of said exhaust force receiving portion and said exhaust force transmission portion, said first and second portions are related as follows:

(A1) for each of said first and second portions, the portion includes a pivot part and an arm part joined together, wherein said part is disposed about a corresponding pivot axis for the portion, and said arm has a length extending from the joining together of said pivot and arm parts to a force transfer subpart of said arm part that transfers said related force between said arm part and another component of the engine;

(A2) for said first and second portions at least one of the following holds:

(i) each of said lengths of said arms of the first and second portions is substantially normal to said corresponding pivot axis for each portion;

(ii) said lengths of said arms are substantially in line;

wherein said pivot parts of said first and second portions are operably adjacent to one another so that each of said and second portions includes a corresponding overhang that is capable of rotating about said pivot part of the other of said portions.

3. A valve train assembly as claimed in claim 1, wherein at least one of said first and second portions is such that said force transfer subpart is capable of being positioned within its said arm part in a plurality of orientations, wherein said length for the arm part is capable of being varied according to which of said orientations that said force transfer subpart is positioned within said arm.

4. A valve train assembly as claimed in claim 1, wherein said first portion includes said intake force receiving portion, and said second portion includes said exhaust force receiving portion.

5. A valve train assembly as claimed in claim 1, wherein said first portion includes said intake force transmitting portion, and said second portion includes said exhaust force transmitting portion.

6. A valve train assembly as claimed in claim 1, wherein said first portion includes said intake force receiving portion, said second portion includes said exhaust force receiving portion, a third portion includes said intake force transmitting portion, and a fourth portion includes said exhaust force transmitting portion, wherein said third and fourth portions are related as follows:

(B1) for each of said third and fourth portions, the portion has a pivot part and an arm part joined together, wherein said pivot part is disposed about a corresponding pivot axis for the portion, and said arm part has a length extending from the joining together of said pivot and arm parts to a force transfer subpart of said arm part that transfers said related force between said arm part and another component of the engine;

(B2) for each of said third and fourth portions, at least one of the following holds:

(i) each of said arms of said third and fourth portions is substantially normal to said corresponding pivot axis of the portion, (ii) said lengths of said arms for said third and fourth portions are substantially in line.

7. A valve train assembly as claimed in claim 1, further including an intake connector for operably connecting said intake force receiving portion and said intake force transmitting portion; and an exhaust connector for operably connecting said exhaust force receiving portion and said exhaust force transmitting portion;

wherein one of said intake connector and said exhaust connector oscillates arcuately about the other of said intake connector and said exhaust connector.

8. A valve train assembly as claimed in claim 7, wherein one of said intake connector and said exhaust connector passes through an interior of the other of said intake connector and said exhaust connector.

9. A valve train assembly as claimed in claim 7, wherein said intake connector and said exhaust connector rotate about a common axis that is coincident with corresponding pivot axes of the first and second portions.

10. A valve train assembly, as claimed in claim 9, wherein said corresponding pivot axes for said first and second portions are coincident with one another and coincident with said common axis.

11. A valve train assembly as claimed in claim 1, wherein when said first portion includes said intake force receiving portion, said force transfer subpart includes a push rod socket for receiving an end of a push rod of the engine.

12. A valve train assembly as claimed in claim 11, wherein said push rod socket is included within an intake arm insert, said intake arm insert mounted within a recess of said arm part of said intake force receiving portion, and said push rod socket is offset from a central axis of said intake arm insert, wherein said central axis of said insert is substantially normal to a direction of said length of said arm part.

13. A rocker arm assembly for an internal combustion engine comprising:

an intake rocker arm subassembly, including components (A1), (A2) and (A3) below:

(A1) an intake actuating arm having a push rod socket for receiving an intake biasing force from a first push rod of the internal combustion engine;

(A2) an intake valve arm having a contact portion for transmitting an actuating force to a fuel intake valve assembly of the internal combustion engine;

(A3) an intake connector for connecting said intake actuating arm and said intake valve arm so that said intake biasing force on said intake actuating arm induces said contact portion of said intake valve arm to bias said fuel intake valve assembly from a first intake predetermined configuration to a second intake predetermined configuration;

an exhaust rocker arm subassembly, including components (B1), (B2) and (B3) below:

(B1) exhaust actuating arm having a push rod socket for receiving an exhaust biasing force from a second push rod of the internal combustion engine;

an exhaust valve arm for transmitting an actuating force to a exhaust valve assembly of the internal combustion engine;

an exhaust connector for connecting said exhaust activating arm and said exhaust valve arm so that said exhaust biasing force on said exhaust activating arm induces said exhaust valve arm to bias said exhaust valve assembly from a first exhaust configuration to a second exhaust configuration;

wherein at least one of said intake connector and said exhaust connector passes through an interior of the other of said intake connector and said exhaust connector;

wherein said intake actuating arm and said intake valve arm are substantially normal to said intake connector, and said exhaust actuating arm and exhaust valve arm are substantially normal to said exhaust connector.

14. A rocker arm assembly for an internal combustion engine comprising:

an intake rocker arm subassembly, including components (A1), (A2) and (A3) below;

(A1) an intake actuating arm having a push rod socket for receiving an intake biasing force from a first push rod of the internal combustion engine;

(A2) an intake valve arm having a contact portion for transmitting an actuating force to a fuel intake valve assembly of the internal combustion engine;

(A3) an intake connector for connecting said intake actuating arm and said intake valve arm so that said intake biasing force on said intake actuating arm induces said contact portion of said intake valve arm to bias said fuel intake valve assembly from a first intake predetermined configuration to a second intake predetermined configuration;

an exhaust rocker arm subassembly, including components (B1), (B2) and (B3) below:

(B1) an exhaust actuating arm having a push rod socket for receiving an exhaust biasing force from a second push rod of the internal combustion engine;

(B2) an exhaust valve arm having a contact portion for transmitting an actuating force to an exhaust valve assembly of the internal combustion engine;

(B3) an exhaust corrector for connecting said exhaust actuating arm and said exhaust valve arm so that said exhaust biasing force on said actuating arm induces said contact portion of said exhaust valve arm to bias said exhaust valve assembly from a first exhaust predetermined configuration to a second exhaust predetermined configuration;

wherein one of said intake connector and said exhaust connector oscillate arcuately about the other of said intake connector and said exhaust connector;

wherein said intake actuating arm and said intake valve arm are substantially normal to said intake connector, and said exhaust actuating arm and exhaust value arm are substantially normal to said exhaust connector.

* * * * *